US007371265B2

(12) United States Patent
Gerfast

(10) Patent No.: US 7,371,265 B2
(45) Date of Patent: May 13, 2008

(54) CONTINUOUS HYDROGEN AND ALCOHOL GENERATOR FROM COAL

(76) Inventor: Sten R. Gerfast, 1802 Valley Curve Rd., Mendota Heights, MN (US) 55118

( * ) Notice: Subject to any disclaimer, the term of this patent is extended or adjusted under 35 U.S.C. 154(b) by 537 days.

(21) Appl. No.: 11/089,396

(22) Filed: Mar. 25, 2005

(65) Prior Publication Data

US 2006/0213125 A1 Sep. 28, 2006

(51) Int. Cl.

| | |
|---|---|
| ***B01J 7/00*** | (2006.01) |
| ***C10J 3/00*** | (2006.01) |
| ***B23K 35/38*** | (2006.01) |
| ***F02N 3/00*** | (2006.01) |
| ***F01L 7/00*** | (2006.01) |

(52) U.S. Cl. ..... 48/61; 48/210; 48/211; 48/212; 48/213; 48/214 R; 48/215; 48/197 FM; 123/188.3; 123/188.8; 123/190.1

(58) Field of Classification Search ..... 48/61, 48/210, 211, 212, 213, 214 R, 215, 197 FM; 123/188.3, 188.8, 190.1
See application file for complete search history.

(56) References Cited

U.S. PATENT DOCUMENTS

| | | | | |
|---|---|---|---|---|
| 2,403,001 | A * | 7/1946 | Jacobi | 123/188.3 |
| 3,630,498 | A * | 12/1971 | Bielinski | 261/87 |
| 3,892,220 | A * | 7/1975 | Franz | 123/190.17 |
| 4,445,910 | A * | 5/1984 | Zimmerman | 48/76 |
| 5,109,814 | A * | 5/1992 | Coates | 123/190.14 |
| 5,149,298 | A * | 9/1992 | Lindee | 452/174 |
| 5,301,640 | A * | 4/1994 | Barranco, Jr. | 123/188.3 |
| 5,437,252 | A * | 8/1995 | Glover | 123/190.2 |
| 5,485,815 | A * | 1/1996 | Shida | 123/188.3 |
| 6,502,533 | B1 * | 1/2003 | Meacham | 123/3 |
| 7,087,331 | B2 * | 8/2006 | Keefer et al. | 429/17 |
| 7,121,247 | B2 * | 10/2006 | Lee | 123/190.8 |
| 2002/0069798 | A1 * | 6/2002 | Aguadas Ellis | 110/229 |
| 2002/0095866 | A1 * | 7/2002 | Hassett | 48/199 FM |
| 2004/0094134 | A1 * | 5/2004 | Redmond et al. | 123/527 |
| 2006/0102130 | A1 * | 5/2006 | Bachelier | 123/190.4 |

FOREIGN PATENT DOCUMENTS

JP 10073236 A * 11/1998

* cited by examiner

*Primary Examiner*—Walter D. Griffin
*Assistant Examiner*—Huy-Tram Nguyen

(57) ABSTRACT

A gas generator with the sole input of air, water and coal that continuously produces hydrogen and carbon monoxide and further reacts these two gases into alcohol. This gas generator/reactor is using its own by-products and is therefore also self sustaining.

19 Claims, 1 Drawing Sheet

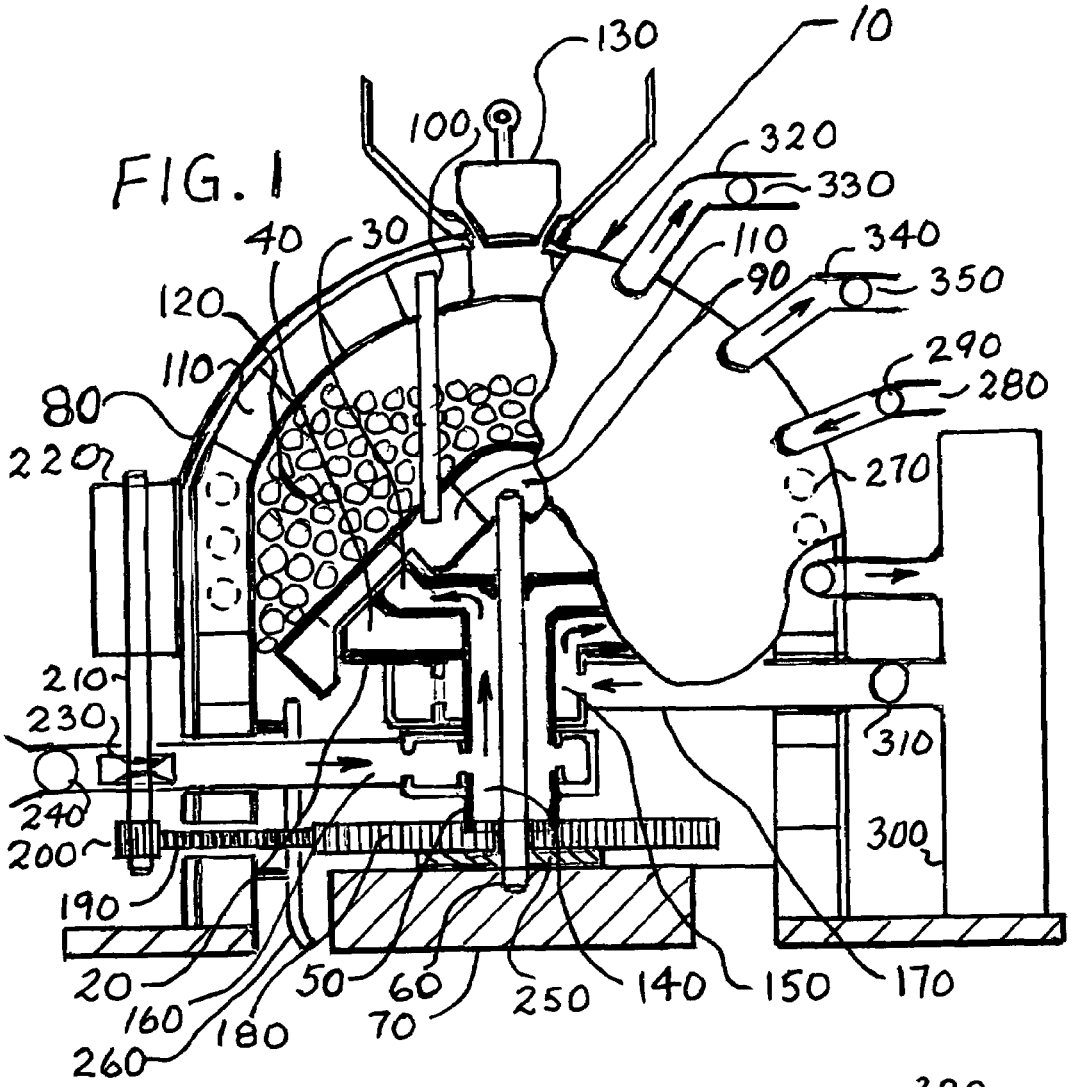
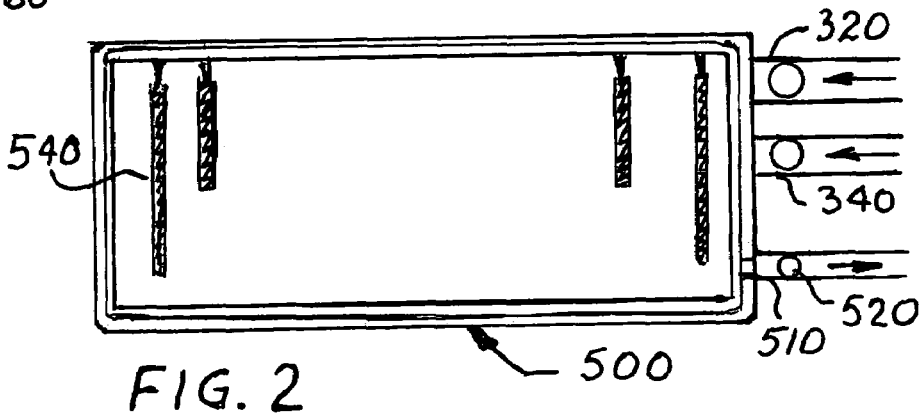
FIG. 2

CONTINUOUS HYDROGEN AND ALCOHOL GENERATOR FROM COAL

TECHNICAL FIELD

This invention generally relates to production generators of gases and fluids. More specifically it relates to a continuous, self sustaining gas generator using coal, that is operated at medium to high temperatures, producing hydrogen, carbon monoxide and alcohol.

BACKGROUND

There is an ongoing search for lower cost energy and less reliance on the oil producing countries. In addition there is a finite supply of petroleum that is mainly used in the transportation industry. Hydrogen fueled cars and airplanes have been proposed, but at the present time the hydrogen to be used are anticipated to be from "re-formed" gasoline, where re-forming is an additional in-efficiency and cost, and again, with this method, still will be crude oil dependent.

Gas generators for the industry and homes have been used in the past but have generally have been both complex and expensive. Gas generators have generally been operated intermittently. Some such intermittent generators, that was used in the past, were the water gas plants in the big cities, that converted coal into gas that was used for heating and lights.

SUMMARY OF THE INVENTION

One of the objectives of this invention is to simplify the gas production and make it less costly as well as making it a continuous process. We have an abundant amount of coal but besides usage in electric power plants, it has not been adapted to many other applications. It is another object of this invention to, from this abundant coal supply, produce hydrogen and alcohol, both, which can be used in fuel cells as well as fuel and raw material for many products.

Methyl alcohol for use in portable fuel cells is already on the market, and is said to replace batteries in electronic appliances such as laptop computers. Another further objective is to have the gas generator self-sustaining, using its own byproducts and use automation for its control as much as possible.

One of the by-products of the present invention's type of a gas generator is heat, that can be used in a heat-engine such as a Stirling engine, that in turn drives a fan for a flow of air, that is also needed in the gas generator. The Stirling engine can also drive a rotating disc at low speed that facilitates air injection into the coal bed.

To sum up, this invention generally relates to production of gases and the possibility of using these gases in a reactor to produce alcohol.

It is a gas generator with the basic conversion of coal or coal type products.

This includes coal, coke, anthracite, charcoal and other related products.

It will hereafter be described as coke. The gas generator is constructed as a tower with a lining made from heat resistant material such as heat resistant bricks or ceramic. The tower also has a centrally located deflector supported with rods to the top of the tower. At its lower section of this deflector there are slots that are enabling gases to be introduced. At the towers upper portion batch-charges of coke can be loaded trough a loading trap that prevents loosing gases or substantial heat when charging. Initially the coke is ignited and air is pumped into the coke batch to render the coke very hot. The air is pumped through a rotating gas injector disc with dual peripheral nozzles, into the above mentioned slots. The air nozzle, that encompasses about 180 degrees of the disc's upper periphery are feed from a non-rotating ring shaped air feeder line. On the lower periphery of the disc is a steam nozzle, encompassing the other 180 degrees of the disc, that is feed from a second non-rotating ring-shaped feeder line connected to a steam supply.

The two stationary ring-shaped supply lines are fixed in the tower, and are also closely fitted around a cylindrical extension on the rotating gas injector disc.

The rotating gas injector disc also has internal passages making it possible to inject two gases alternately but continuously, at two different, changing, injections angles. As described above, these angles could be 180+180 degrees or other angular splits. The rotating disc is supported by a central shaft, fixed at the base of the tower, on one end and on the deflector on the other end.

The two peripheral nozzles on the disc are closely fitted into lower openings of a conical fixed deflector that is supported from the roof on the tower. This deflector is slightly smaller then the inside diameter of the tower to provide a passage for ashes from the burned coke into an ash pit. An ash deflector can also be fitted to protect rotating parts and bearings. The bearings and thrust washers for the above mentioned rotating parts are preferably made from high temperature, low friction materials such as graphite that is usable at least up to 3500° degrees F. Another place where graphite, or similar material or coating is useful, is in the peripheral outlets on the disc fitted into the conical deflector.

The disc, and its cylindrical extension, is driven by a large spur gear, an idler gear and a small gear on the outside of the tower.

After that the ignited coke, through air injection, has reached the operating temperature, the rotating air nozzles on the disc is continuing to hold that temperature in approximately 180 degrees of the charge, while at the same time steam is injected, through the rotating steam nozzles, in the other 180 degrees of the charge, to provide for a continuous coke reduction operation.

The steam injection into the hot bed of coke reduces the hot coke into hydrogen and carbon monoxide according to the formula C+H2O=CO+H2 This reduction is an endothermic reduction that lowers the temperature of the coke in front of the steam injection, requiring re-heating that is provided by the air injection that follows.

The rotational speed of the disc is adjusted to maximize the hydrogen and carbon monoxide output. The pre-determined time to maximize the output can also be altered by the angular partition ratios of the two gas inlets in the disc. The production of hydrogen and carbon monoxide is therefore continuous. The output of the hydrogen is at a pipe at the top of the tower, with hydrogen being the lightest element known. The carbon monoxide, with about the same density as air, is channeled to an output further down on the tower The area in the charge where the injection of air increases the temperature of the coke is also the highest temperature on the outside of the tower.

The "hot" piston of a Stirling hot air engine can be attached to this part of the gas generator tower.

The output shaft of the Stirling engine can have a reduction gear driving the gas injector disc at low speed. And the same output shaft, without the reduction gearing, can drive a fan for supplying the air feeder line, for injection through the injection disc, into the tower.

The steam, that is injected, can be made from water in a heat exchanger coil surrounding the hot tower. The generated steam is collected and controlled by a flow control. Similar control devices are used for the air supply, water inlet and coke supply inlets, and hydrogen and carbon monoxide outlets.

The inputs of the present invention therefore are air, water and coke and the outputs are hydrogen, carbon monoxide, heat for heating (or for a heat engine) and ash (that is also usable) The hydrogen is an excellent gas for fuel cells and for a multitude of commercial applications, and of course can also be used in future fuel cell driven cars.

Carbon monoxide has excellent fuel value and can also be used by it self in many industrial processes. The present invention could be described as:

A continuous, self-sustaining hydrogen and carbon monoxide gas generator comprising:

A rotating gas injector disc having a first air injection nozzle, a second steam injector nozzle, alternately but continuously injecting air and steam at changing injection angles into a tower containing a hot bed of coke, reducing it to hydrogen and carbon monoxide. Another embodiment of the present invention is to use the output gases of the above gas generator in a separate, pressurized, chamber combining and react the hydrogen with the carbon monoxide into an alcohol in the presence of a catalyst.

The catalyst can be zinc oxide or other oxides or catalytic metals, that could be applied as a coating on the walls of this separate chamber or as hanging plates of catalytic materials.

The reaction product can be methyl alcohol (CH3OH) according to the formula: CO+2H2=CH3OH The methyl alcohol can be directly and cleanly transformed into electricity in a fuel cell with only water as a by-product. The fuel cell can be as small as a battery for a laptop computer or as large as a power generation station for an electric company This combination could be described as:

A continuous, self-sustaining gas generator and reactor producing alcohol comprising:

A rotating gas injector disc having a first air injection nozzle, a second steam injector nozzle, alternately but continuously injecting air and steam into a tower containing a hot bed of coke, reducing it to hydrogen and carbon monoxide further reacting said gases into methyl alcohol in the presence of a catalyst.

The above description and illustrations that are shown are by no means conclusive, a person skilled in the art could easily make many other uses and configurations, and suggest other reaction products and catalysts that can be used in the chamber feed by the basic gas generator.

BRIEF DESCRIPTION OF THE DRAWING

FIG. 1 is a partial cross section of the gas generator of the present invention.

FIG. 2 is a cross section showing the reactor portion of the generator/reactor of this invention.

DETAILED DESCRIPTION OF THE DRAWING

FIG. 1 is showing a partial cross section of the gas generator 10 of the present invention with the rotating gas injector disc 20 having an air injector nozzle 30 a steam injection nozzle 40, and a cylindrical extension 50. They are all rotating around a shaft 60 fixed at its lower end in the base 70 of a tower 80 and at its upper end in a deflector 90 that is supported by rods 100 at the top of the tower 80. The tower 80 and the deflector 90 have heat resistant linings 110. The tower 80 is replenished as needed with a batch of coke 120 through a loading trap 130. The deflector 90 has slots wherein nozzle 30 and nozzle 40 are fitted. The cylindrical extension 50 with internal passages 140 and 150 is fitted to a first ring-shaped air supply line 160 and a second ring-shaped steam supply line 170, with both supply lines fixed to die tower 80. On the lower section of the cylindrical extension 50 a spur gear 180 is attached. This gear is connected to an idler gear 190 and again to a smaller gear 200 that is attached to a shaft 210 that is driven by a motor 220. If that motor 220 is of the Stirling heat engine type, its "hot cylinder" is attached to the hot wall of the tower 80 to produce rotation on shaft 210 that will also rotate gear 200. Also driven by shaft 210 is a fan 230, with a control function 240, in the air supply line 160 providing compressed air into supply line 160. The bearing 250 for the rotating disc 20 is typical of bearings used and are of a heat resistant type. After the coke 120 is reduced ashes from the coke fall down between the deflector 90 and heat resistant lining 110. An ash protector 260 protecting the gear in that area is placed close to the deflector 90. A heat exchanger coil 270 surrounding the tower 80 has an inlet 280 of water that also has a control device 290 and an outlet of steam into a container 300 with an additional outlet control device 310. Outlet pipe 320 for hydrogen with a control device 330 and a second outlet pipe 340 for carbon monoxide with its control device 350 is placed near the top of the tower.

FIG. 2 shows a reactor container 500 having an inlet pipe 320 containing hydrogen and an inlet pipe 340 containing carbon monoxide, that are both continuations from the pipes oil the tower 80 with the same numbers, and an outlet pipe 510 for alcohol, with a control device 520. Inside the container 500 are catalytic plates 540.

I claim:

1. A continuous, self-sustaining hydrogen and carbon monoxide gas generator comprising:

A rotating gas injector disc having a cylindrical extension with internal passages to a first air injection nozzle and a second steam injector nozzle, and said extension is fitted to a first ring-shaped air supply line fixed to a tower, and said extension is also fitted to a second ring-shaped steam supply line, also fixed to said tower, alternately but continuously injecting air and steam at changing injection angles into said tower containing a hot bed of coke, reducing it to hydrogen and carbon monoxide.

2. A continuous, self-sustaining gas generator and reactor producing alcohol comprising:

A rotating gas injector disc having a cylindrical extension with internal passages to a first air injection nozzle and a second steam injector nozzle, and said extension is fitted to a first ring-shaped air supply line fixed to a tower, and said extension is also fitted to a second ring-shaped steam supply line, also fixed to said tower, alternately but continuously injecting air and steam into, said, tower containing a hot bed of coke, reducing it to hydrogen and carbon monoxide, further reacting said gases into methyl alcohol in the presence of a catalyst.

3. The continuous self-sustaining gas generator as defined in claim 1 wherein a charge of coke is loaded into said tower, said coke is ignited and air is injected through said disc's first said nozzle until said coke has achieved at least 800degree C., when steam is injected through said second nozzle, reducing the hot coke into hydrogen and carbon monoxide that exits into output pipes in said tower, with the injection disc's rotation providing a constantly renewed air injection and steam injection to maintain correct reducing temperature and maximizing gas production in said tower.

4. A continuous gas generator and reactor producing alcohol as defined in claim 2 having a rotating gas injector disc with a first air injection nozzle, and a second steam injector nozzle alternately but continuously injecting air and steam into a tower containing a hot bed of coke, providing a constantly renewed air and steam injection, reducing said coke to hydrogen and carbon monoxide and further reacting said gases into methyl alcohol in the presence of a metal oxide catalyst.

5. A continuous gas generator as defined in claim 1 wherein said first nozzle is circumscribing 180 degrees on the upper part of said disc, and said second nozzle is circumscribing the other 180 degrees on the lower part of said disc.

6. A continuous gas generator as defined in claim 5 wherein said circumscribed 360 degrees can be split into different angles for said first and second nozzles.

7. A continuous gas generator as defined in claim 1 wherein said steam supply line is connected to a heat exchanger that is using the heat from said tower to heat water to steam.

8. A continuous gas generator as defined in claim 2 wherein said cylindrical extension is fixed to a drive gear driven through an idler gear in the wall of said tower, into a smaller gear on the outside of said tower.

9. A continuous gas generator as defined in claim 1 wherein said rotating disc is having a central shaft fixed to the base of said tower on one end and the other end of said shaft fixed to a centrally located deflector supported with rods to the top of said tower.

10. A continuous gas generator as defined in claim 9 wherein said disc's dual nozzles are fitted into slots in said deflector.

11. A continuous gas generator/reactor as defined in claim 2 wherein said hot bed is conducting heat to the outside of said tower where said heat is conducted into "the hot cylinder" of a Stirling heat engine producing rotation on its output shaft.

12. A continuous gas generator as defined in claim 11 wherein said output shaft is driving a fan for compressing air for usage in said air nozzle.

13. A continuous gas generator as defined in claim 11 wherein said output shaft is driving said disc.

14. A continuous gas generator as defined in claim 11 wherein said shaft, gears and all rotating parts are having bearings and support washer made from heat resistant graphite material or other materials with service temperature of 3500 degree F or greater.

15. A continuous gas generator as defined in claim 1 wherein said bed of coke is replenished as needed by a controlled loading trap.

16. A continuous gas generator as defined in claim 1 wherein the sole input to said gas generator is air, water and coke and the output is hydrogen and carbon monoxide.

17. A continuous gas generator as defined in claim 2 wherein the output of said generator is hydrogen and carbon monoxide that is further fed into a reactor container reacting these two gases under pressure into an alcohol.

18. A continuous gas generator/reactor as defined in claim 2 wherein the output of said reactor is pressurized, containing a catalyst, and the reduction product is methyl alcohol.

19. A continuous gas generator as defined in claim 3 wherein output pipes have control valves and input of air, water, steam and coke have controlling devices controlled by a micro controller.

* * * * *